United States Patent [19]

Scarpellino, Jr et al.

[11] 4,189,358

[45] Feb. 19, 1980

[54] ELECTRODEPOSITION OF RUTHENIUM-IRIDIUM ALLOY

[75] Inventors: Anthony J. Scarpellino, Jr, Tuxedo, N.Y.; William G. Borner, Ringwood, N.J.

[73] Assignee: The International Nickel Company, Inc., New York, N.Y.

[21] Appl. No.: 924,632

[22] Filed: Jul. 14, 1978

[51] Int. Cl.[2] ..... C25D 3/50; C25B 11/08; C25B 11/10; C25C 1/00

[52] U.S. Cl. ..... 204/43 N; 204/105 R; 204/105 M; 204/106; 204/108; 204/107; 204/109; 204/110; 204/111; 204/112; 204/113; 204/114; 204/115; 204/116; 204/117; 204/123; 204/290R; 204/290 F; 204/293

[58] Field of Search ..... 204/290 R, 290 F, 293, 204/43 N, 48–49, 112–113, 105 R, 106–108, 109–111, 114–117, 105 M, 123

[56] References Cited

U.S. PATENT DOCUMENTS

| | | | |
|---|---|---|---|
| 3,616,445 | 10/1971 | Bianchi et al. | 204/290 F |
| 3,846,273 | 11/1974 | Bianchi et al. | 204/290 F |

*Primary Examiner*—R. L. Andrews

*Attorney, Agent, or Firm*—Ewan C. MacQueen; Miriam W. Leff

[57] ABSTRACT

Ruthenium-iridium electrodeposits are prepared from aqueous acid solution containing ruthenium, iridium, a fluoborate salt, fluoboric acid, and optionally sulfamic acid. The baths are especially useful for preparing insoluble anodes.

38 Claims, 2 Drawing Figures

ELECTRODEPOSITION OF RUTHENIUM-IRIDIUM ALLOY

The present invention relates to a method and a bath for the electrodeposition of ruthenium-iridium alloys. More particularly it concerns the electro co-deposition of ruthenium-iridium alloys as adherent, coherent, reproducible deposits which are highly resistant to corrosion. It also relates to the use of such baths for plating of conductive articles.

It is well known to apply expensive precious metals on more readily available, cheaper, or more easily fabricated substrates to obtain products with properties attributable to the expensive surface materials. The present baths may be used to plate a great variety of materials which are either conductive or can be made conductive, and the plated articles may be used for a variety of decorative or functional purposes which require properties satisfied by the deposited alloy. It has been found, for example, that the present baths can be used to plate valve metals, with and without intermediate coatings, and the composite materials formed are useful in developing insoluble anodes. Accordingly, the present invention will be described below with particular reference to insoluble anodes, and more particularly with insoluble anodes for electrowinning metals.

Anodes made of platinum group metal-coated valve metals are known. The platinum group metals have been used, for example, in surface coatings and as intermediate layers. U.S. Pat. No. 3,775,284, for example, proposes a platinum-iridium barrier layer, and U.S. Pat. Nos. 3,616,445, 3,810,770, 3,846,273 and 3,853,739 show examples of proposed anodes for various uses which have an outer layer containing—in addition to ruthenium oxide and titanium oxide—iridium and/or iridium oxide. These patents propose a variety of methods for depositing ruthenium-iridium coatings. It is appreciated by those skilled in the art that the coatings obtained by different methods are not identical. They may vary, for example, with respect to durability, electrical properties such as overvoltages for production of products or reactions, and reproducibility. Also, there may be material differences in the cost of producing coatings which will meet the requirements. One of the most attractive methods for depositing a coating from a standpoint of cost is by electroplating from an aqueous bath at moderate temperatures. Electroplating offers a simple and direct route which is neither time nor labor intensive. It is of interest that although it has been proposed to deposit the anode coatings by electroplating techniques, it appears that in practice it has not been found satisfactory. For example, L. D. Burke et al in an article in J.C.S. FARADAY I, Vol. 73, No. 11, pp. 1659–1849 (1977), entitled "The Oxygen Electrode" states that $RuO_2$-coated electrodes are usually prepared by heating $RuCl_3$-painted titanium in air for several hours, and also that electrodeposited coatings were investigated and found unsatisfactory.

Several baths have been developed for electroplating ruthenium and for electroplating iridium. Examples of ruthenium electroplating baths can be found in U.S. Pat. Nos. 2,057,638, 2,600,175, 3,123,544, 3,576,724, 3,630,856, 3,793,162 and 4,082,625. Examples of iridium plating baths can be found in U.S. Pat. Nos. 1,077,920 3,554,881, 3,639,219, in Lowenheim's MODERN ELECTROPLATING, 3rd Ed., pp. 354–355 (1974), and in an article by G. A. Conn entitled, "Iridium Plating" in PLATING PROCEEDINGS, pp. 1258–1261, (1965). In general, ruthenium is considered more difficult to plate than such metals as platinum and palladium, and iridium is considered more difficult to plate than ruthenium. Baths for electrodeposition of certain alloys of ruthenium have also been disclosed, e.g., for Ru-Rh, Ru-Pt, and Ru-Pd in U.S. Pat. No. 3,692,641 and for Rh-Ru in U.S. Pat. No. 3,892,638. None of the patents noted above discloses a bath for co-depositing ruthenium and iridium.

It is an object of the present invention to provide a plating bath which co-deposits an adherent, coherent, reproducible ruthenium-iridium alloy. A further object is to provide a composite material comprising a valve metal substrate and a ruthenium-iridium alloy layer which is useful as an electrode, particularly as an anode for electrowinning metals. Another object is to provide a process for efficient electro co-deposition of a ruthenium-iridium coating. Still another object is to provide a bath which will deposit essentially stress-free ruthenium-iridium coatings, which are substantially free of cracks on eye examination and up to a magnification of 500X at a thickness equivalent to a loading of up to at least about 2 mg/cm$^2$. A further object is to provide a bath and method for electrodepositing a ruthenium-iridium alloy with varying amounts of predetermined iridium.

Other objects and advantages will become apparent from the following description and accompanying figures.

BRIEF DESCRIPTION OF FIGURES

FIG. 1, with plating directly on copper, shows cracks at a Ru-Ir loading of 1 mg/cm$^2$. FIG. 2, with plating on the palladium coated copper, shows no cracks at a Ru-Ir loading of 1.9 mg/cm$^2$.

SUMMARY OF INVENTION

Figure 1:
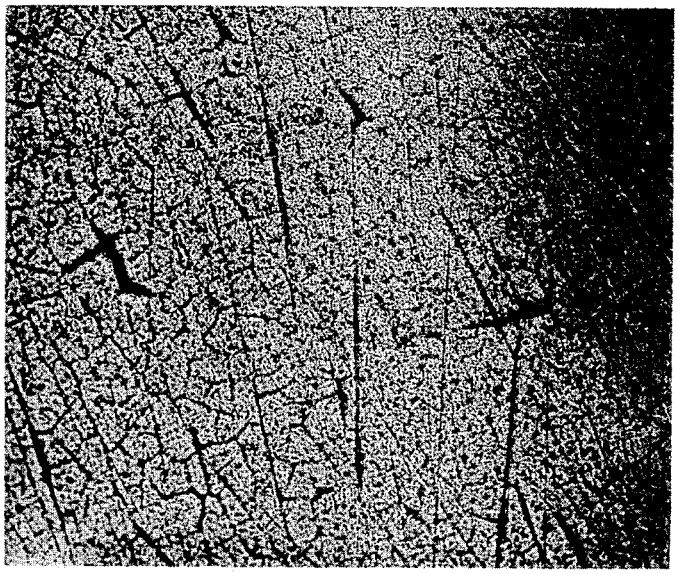
FIGS. 1 and 2 are photomicrographs at 500X magnification which show the quality of a Ru-4-6Ir alloy deposit from a bath of the present invention on two different surfaces. In both samples the substrate is copper polished metallographically to a 1 μm diamond finish, but in FIG. 1 plating is directly on the copper and in FIG. 2 plating is on copper covered with 0.15 mg/cm$^2$ of palladium.

In accordance with the present invention a ruthenium-iridium alloy is electrodeposited from an aqueous solution comprising a soluble ruthenium compound, a soluble iridium compound, a soluble fluoborate salt, and fluoboric acid.

It has been found that baths containing controlled amounts of both a soluble fluoborate salt and fluorboric acid co-deposit ruthenium-iridium alloys having controlled amounts of iridium, that such baths are long lasting and stable over a wide ratio of ruthenium-iridium compositions, and that deposits can be formed which are substantially crack-free under eye examination and at a magnification of 500X at thicknesses equivalent in a loading of up to at least about 2 mg/cm$^2$.

In accordance with a preferred aspect of the present invention, particularly adherent and durable coatings are deposited from baths prepared from ruthenium compounds containing complex anions of Ru IV, often referred to as "RuNC". Such complex anions have been represented by the formula $[Ru_2N(H_2O)_2Y_8]^{3-}$ wherein Y is chlorine or bromine. A method of preparing this ruthenium compound is given in U.S. Pat. No. 3,576,724, which also discloses ruthenium plating baths using such compounds. Also preferred are baths prepared from an iridium compound made by a method disclosed in copending application Ser. No. 924,618 filed July 14, 1978 and incorporated herein by reference.

In accordance with another aspect of this invention, a composite material is provided comprising a valve metal substrate and a ruthenium-iridium alloy electro codeposited using the bath described herein. Preferably the electroplated layer has a thickness of at least about 0.1 μm, and also preferably the electroplated alloy is at least partially oxidized to provide a corrosion resistant, electrocatalytically active oxide at the surface.

DETAILED DESCRIPTION OF INVENTION

The Plating Bath

The plating baths of the present invention are aqueous solutions comprised of the soluble ruthenium and iridium components and a soluble fluoborate salt, fluoboric acid, and optionally sulfamic acid. As will be described in further detail below the fluoboric acid and fluoborate salts are important components of the baths. In general, baths according to the present invention are aqueous solutions comprising:

| Ingredient | g/l |
|---|---|
| Ru | 1-12 |
| Ir | 1-12 |
| $NaBF_4$* | 10-200 |
| $HBF_4$ | 1-100 |
| $NH_2SO_3H$ | 0 to 2 times the Ru + Ir Conc. |

(*or equivalent fluoborate salt)

The bath may additionally contain other additives well known in the art; for example boric acid and/or doping agents. Boric acid is known to prevent hydrolysis of $HBF_4$ to HF.

Advantageously, the present baths can be designed to give the desired levels of iridium in the alloy deposited, ranging from very small but effect amounts, e.g. to improve the quality of the deposits and/or corrosion resistance up to about 36 weight percent. The fluoborate salt and the fluoboric acid are major factors in controlling the level of iridium in the deposit and in controlling the quality of the deposit. The concentrations of such components used for such control are interrelated to each other and to the precious metal concentrations in the bath.

The fluoborate salt functions at least as a current carrier in the bath and it can be used to regulate the viscosity of the bath. It also affects the quality of the deposit, as will be shown below. The fluoborate salt can be, e.g., an alkali metal or ammonium fluorborate. Preferably, for reasons of cost sodium fluoborate is used. Based on sodium fluoborate the concentration of fluoborate salt is equivalent to about 10 g/l to about 200 g/l sodium fluoborate, preferable amounts will depend on the compositional design of the bath, but in general the bath will preferably contain at least about 25 g/l equivalent of fluoborate salt. For a bath depositing about 2-4 weight percent iridium in the alloy, the bath will preferably contain about 25 to about 150 g/l, e.g., about 100 g/l. Suitability the bath will have a density of about 6 to about 8 Bé°.

The fluoboric acid level can be used to control the level of iridium in the deposit. Its presence also improves the quality of the deposits. Without fluoboric acid deposits are severely cracked. When added the cracks are reduced materially. In general fluoboric acid is present in an amount of about 1 g/l to about 100 g/l. Preferable amounts will depend on the design of the bath for a particular deposit. To obtain a 2-4 weight percent iridium in the deposit, the bath will preferably contain, at least about 5 g/l, e.g. about 5 to about 50 g/l, more preferably about 10 to 40 g/l fluoboric acid.

Generally, ruthenium is present as a soluble compound, but in a preferred embodiment the bath is prepared from a salt containing ruthenium in a complex anion which may be prepared as described in U.S. Pat. No. 3,576,724. Preferably the bath is prepared from the ammonium salt of the complex, e.g. $[Ru_2N(H_2O)_2Y_8](NH_4)_3$, wherein Y=either a chloro or bromo group. Examples of other ruthenium salts that may be used are halides and sulfamates.

Generally, iridium is present as a soluble compound, but in a preferred embodiment the bath is prepared using as the iridium component the reaction product of a diammonium hexahalo salt of iridium and sulfuric acid, as described in the aforementioned co-pending application Ser. No. 924,618. For example, the iridium compound may be prepared as follows: The diammonium hexachloro salt of iridium, viz. $(NH_4)_2IrCl_6$, and sulfamic acid are refluxed for a sufficient amount of time to permit the formation of an olive green precipitate, which forms after distillation and cooling. For such precipitate to form, it is necessary to reflux the reactants for more than 30 hours, e.g. 50 hours. To be a useful constituent of the electroplating bath, the resultant iridium product must be washed thoroughly, e.g. until the precipitate is substantially uniformly olive green in color. The iridium product is soluble in water. Hence, to minimize dissolution, washing is carried out preferably below room temperature, e.g. at about 0° to 5° C. Examples of other iridium compounds that may be used in the bath are iridium sulfamates and halides.

While the bath may contain relatively large amounts of ruthenium and iridium, it is preferred to keep the precious metal content of the bath at a low level. This will prevent loss of metal due to drag out and it is less costly to operate with lower precious metal inventories. In preferred baths the ruthenium and iridium contents are less than 12 g/l, respectively, and preferably about 3 to 10 g/l, respectively. The ratio of ruthenium to iridium in bath, surprisingly, can be varied widely without affecting the ratio of iridium in the deposit. Since the ruthenium is deposited at a faster rate than iridium, this attribute permits the bath to be usable for a particular alloy composition even though the bath composition is changing. In general, however, the initial bath is formulated to contain ruthenium and iridium in approximately a 1:1 weight ratio. As needed the electrolyte can be replenished by adding a solution with ruthenium and iridium in concentrations equivalent to the composition of the deposit.

Sulfamic acid serves as a stress reliever of the deposit. It is optional, but preferably present in the bath in a ratio of about 0.1:1 up to about 2:1 of sulfamic acid:total weight Ru+Ir, preferably about 0.5:1.

Plating Conditions

Electrodeposition is carried out at a temperature in the range of about room temperature up to about 95° C., preferably about 50 to 70° C. and at a cathode current density of about 5 to 120 mA/cm$^2$, preferably about 20 to 100 mA/cm$^2$.

The pH of the aqueous plating bath is important. If it is not maintained within certain tolerable limits, iridium will not co-deposit. The optimum pH range for the ruthenium co-deposit is about 0.3 to about 1.5, preferably about 0.9 to about 1.3. The pH is maintained, advantageously, with fluoboric acid or sulfamic acid.

The Deposits

The above described baths operate at the given conditions co-deposit iridium and ruthenium containing about 0.1 to 36% iridium. As indicated the bath can be designed for specific iridium content in the deposited alloy.

Major advantages of baths of the invention are that reproducible coatings can be deposited over wide ranges of Ru:Ir ratios in the bath, the baths can be operated for a longer period of time without adjustment, the iridium level can be controlled at a low but effective level for a desired effect and that iridium can be co-deposited with ruthenium. Moreover, adherent and coherent ruthenium-iridium alloys can be deposited.

Electroplating baths according to the present invention can be used to obtain ruthenium-iridium alloy deposits which are shiny without cracks on eye examination and at magnifications up to about 500X at thicknesses equivalent to a loading of up to at least about 2 $mg/cm^2$. The baths can be used to obtain substantially continuous deposits having a thickness of at least about 0.1 μm. When applied as coatings for use as electrode materials in electrolysis applications, preferably the deposits have a thickness of about 0.1 to about 5 μm, and optimally up to a thickness of about 3 μm. Below about 0.1 μm the co-deposit is not continuous and exposes too much of the substrate.

The Substrates

For electrolytic applications the present bath can be used to deposit coatings on current carrying substrates. Valve metal substrates are especially useful as substrate materials when the coated components are used for electrolysis purposes in acidic media.

Figure 2:
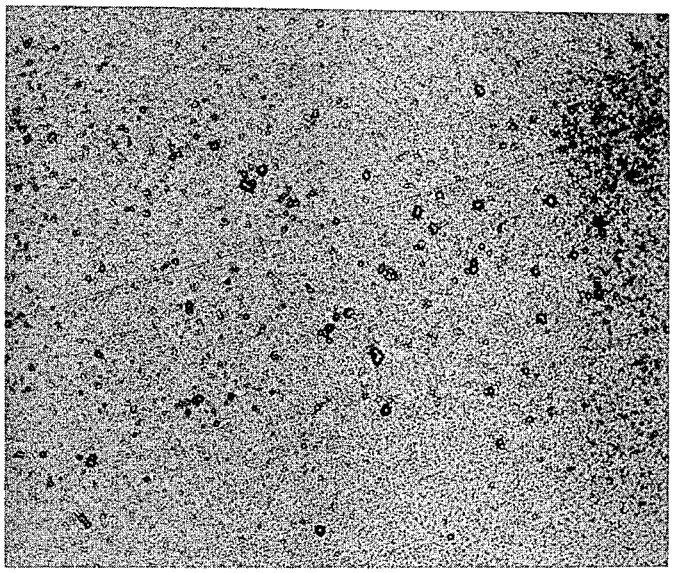

Advantageously, particularly for electrowinning applications the valve metal can be coated with a barrier layer, e.g. comprising platinum group metals, gold and nitrides, carbides and silicides of one of the components of the substrate. As shown in FIGS. 1 and 2 a palladium coating, e.g. on a polished copper surface, improved the quality of the deposit. Similar findings have been made with gold and iridium coatings on copper.

As used herein, the term "alloy" as applied to a ruthenium-iridium deposit, means that the film contains a mixture of very fine particles of ruthenium and iridium which has a metallic appearance. The particles may be mixed crystals or in solid solution, the microscopic character of the deposited films being different to determine because films are very thin. By "valve" metals is meant those metals form oxide films under anodic conditions, as do, for example, titanium, tantalum, niobium, tungsten, zirconium, aluminum, hafnium and alloys thereof with each other and with other metals. The platinum group metals are platinum, palladium, rhodium, ruthenium, osmium and iridium. The terms electroplated and electrodeposited are used interchangeably. The abbreviations g/l and w/o mean grams per liter and weight percent, respectively, and ruthenium-iridium alloy compositions are given in weight percent.

The following examples are given to illustrate the invention.

EXAMPLE 1

This example is given to illustrate a method of preparing a ruthenium component of the bath.

Fifty grams of $RuCl_3.3H_2O$ and 300 grams of $NH_2SO_3H$ (sulfamic acid) are dissolved in 1000 ml of distilled water. The solution is refluxed continuously for 30 hours in a reflux apparatus. Then 700 ml of the refluxed solution is distilled off in a distillation apparatus. The distillate is a clear, colorless liquid which gives a positive $Cl^-$ ion test when $AgNO_3$ is added to it. The remainder, a very dark, red-orange-brown solution, is allowed to cool and stand overnight at room temperature. Upon standing, a brick to rust red precipitate settles to the bottom of the flask. The precipitate is collected by filtration, washed with ice water and dried in a desiccator. Ice water is used because the salt is very soluble. This is the first "crop" of precipitate from the remainder of the refluxed solution. By allowing the filtration and rinse water to stand overnight again and again, a second and third crop of precipitate can be filtered from the solution. (Even after the third crop, the solution is very darkly colored, indicating the presence of ruthenium.) In one such preparation, Crop I yielded 30 grams, Crop II yielded 7 grams, Crop III yielded 20 grams. Individually, the color of the salts could be called brickrust-red, but the color of the salt becomes detectably browner with each crop.

Analysis showed the ruthenium content to be 34.5% in Crop I, 35.2% in Crop II and 34.1% in Crop III. An x-ray diffraction analysis and an IR spectrographic analysis on Crop I gave a pattern having the same major lines as the standard $(NH_4)_3[(RuCl_4.H_2O)_2N]$, which is the ammonium salt of the chloro-containing embodiment of the complex referred to above as RuNC.

EXAMPLE 2

This example is given to illustrate an iridium component of the bath.

A. Twenty-five grams of $(NH_4)_2IrCl_6$ and 60 grams of $NH_2SO_3H$ are dissolved in 600 ml of distilled water. The solution is refluxed continuously for 71 hours. Then 550 ml of the refluxed solution is distilled off in a distillation apparatus. The distillate is a clear, colorless solution which gives a positive test for $Cl^-$ ion when $AgNO_3$ is added to it. The remainder of the solution is dark murky green, which upon cooling yields a thick precipitate to settle. The precipitate is collected on filter paper and washed several times with ice water. After air drying, it is transferred to a desiccator to dry. Approximately 11 grams of an olive green salt is the result. The filtrate and rinse water will yield more of this green salt, but only after considerable standing or by reduction of the volume by another distillation. The iridium content of two different preparations were 44.4% and 45.1%. X-ray diffraction analysis of these salts gave a similar pattern, which was different from that of $(NH_4)_2IrCl_6$, the starting material. It appears from the IR spectrograph of the green salt that there is $H_2O$ present but no nitrogen bridge. Chemical analysis shows it to contain 44.4% Ir, 41.1% Cl, 5.3% N, 5.1% O, 4.12% $NH_4$, 0.71% $H_2O$, and the presence of H. No S is present. Its melting point is above 350° C.

B. The above procedure is repeated except that the solution of diammonium hexachloro iridium (IV) in sulfamic acid is refluxed for only 30 hours. The iridium salt does not react in this time period.

EXAMPLE 3

This example illustrates the effect of iridium addition to a ruthenium sulfamate bath.

To an aqueous bath containing 2 to 3 g/l ruthenium formulated with RuNC prepared as in EXAMPLE 1, is added various amounts of the reaction product of the refluxed diammonium hexachloro iridium IV salt, as prepared in EXAMPLE 2. The iridium component is added in amounts to make up baths containing approximately 10%, 20%, 30%, 40%, 50%, 70% and 90%, by weight of iridium. At a plating temperature of 55° C., and a current density of 20 mA/cm$^2$ it was found that at a concentration of about 45% iridium in the bath, the level of iridium in the deposit reaches a maximum of about 15% by weight. Thereafter, the % of iridium in the deposit levels off. In other words increasing the amount of iridium over 45 weight percent in the bath tested, did not increase the amount of iridium in the deposit.

EXAMPLE 4

This example illustrates the interrelationships of the iridium, fluoborate, and fluoboric acid concentrations in the baths on the level of iridium in the deposited alloys.

A series of plating baths are formulated as aqueous solutions containing ruthenium, iridium, sodium fluoborate, fluoboric acid and sulfamic acid. All baths are prepared using as the ruthenium and iridium components, salts made substantially as described in EXAMPLES 1 and 2, respectively, and to give a 1 to 1 weight ratio of ruthenium and iridium in the baths, and the sulfamic acid concentration in each bath is 6 to 7 g/l but the components are otherwise varied relative to each other. The baths have an initial pH in the range of about 1.2 to 0.5 and deposits of ruthenium-iridium alloys are made at plating conditions of 55°-60° C. and 20 mA/cm$^2$ on a copper substrate using a platinum anode. The deposited alloys are analyzed for iridium content by x-ray fluorescence. Results are tabulated in TABLES I and II.

The experiments in TABLE I show the effect of variations in iridium and fluoboric acid concentrations in baths containing 25 g/l $NaBF_4$. The experiments in TABLE II show the effect of variations in iridium and fluoboric acid concentration in the baths at various levels of $NaBF_4$.

The data in TABLES I and II show the interrelationship of the concentrations of Ir, $NaBF_4$ and $HBF_4$, and from such data a bath composition can be optimized to give the desired deposit for a particular application.

TABLE I

| Test | $NaBF_4$ = 25 g/l Ru:Ir = 1:1 Bath Ir/$HBF_4$ Weight Ratio | | Deposit Ir in Alloy w/o |
|---|---|---|---|
| A | 3.08/.66 | 4.65 | 16.6 |
| B | 3.08/10.46 | 0.29 | 4.0 |
| C | 6.16/10.46 | 0.59 | 9.4 |
| D | 6.16/20.3 | 0.30 | 2.1 |

TABLE II

| Test | Bath Ir/$HBF_4$ Weight Ratio | | Bath $NaBF_4$ g/l | Deposit Ir in Alloy w/o |
|---|---|---|---|---|
| A | 3.08/0.66 | 4.65 | 25 | 16.6 |
| B | 3.08/10.46 | 0.29 | 25 | 4.0 |
| E | 3.08/3.31 | 0.93 | 50 | 14.8 |
| F | 3.08/13.11 | 0.23 | 50 | 6.8 |
| G | 3.08/21.46 | 0.14 | 50 | 3.4 |
| H | 3.08/4.39 | 0.70 | 75 | 23.2 |
| I | 3.08/14.0 | 0.22 | 75 | 8.1 |
| J | 3.08/33.50 | 0.09 | 75 | 6.0 |
| K | 3.08/0.33 | 9.29 | 100 | 17.4 |
| L | 3.08/9.60 | 0.32 | 100 | 5.4 |
| M | 3.08/39.02 | 0.08 | 100 | 1.8 |

EXAMPLE 5

This example illustrates the effect of fluoborate level on the performance of deposits used in the preparation of anodes.

Baths are prepared and deposits made substantially as described in EXAMPLE 4, except that the deposits are made on titanium. The composite Ru-Ir on Ti materials are treated at 593° C. in air for 15 minutes and then subjected to a screening test (ALTC) in 1 N $H_2SO_4$ at ambient temperature and an anode current density of 500 mA/cm$^2$. Results are tabulated in TABLE III, which gives variations in compositions of the baths, w/o iridium in the deposits and the hours to 10 volts cell voltage in the screening test.

TABLE III

| Test | Bath Ir/$HBF_4$ Weight Ratio | | Bath $NaBF_4$ g/l | Deposit Ir in Alloy w/o | Performance ALTC Hours to 10 Volts |
|---|---|---|---|---|---|
| N | 3.08/9.27 | 0.33 | 0 | 7.8 | 15 |
| O | 3.08/10.46 | 0.29 | 25 | 4.0 | 91 |
| P | 3.08/3.11 | 0.23 | 50 | 6.8 | 90 |
| Q | 3.08/14.10 | 0.22 | 75 | 8.1 | 112 |
| S | 1.38/9.8 | 0.14 | 150 | 11.0 | 178 |

TABLE III-continued

| Test | Bath Ir/HBF4 Weight Ratio | | Bath NaBF4 g/l | Deposit Ir in Alloy w/o | Performance ALTC Hours to 10 Volts |
|---|---|---|---|---|---|
| T | 1.38/9.8 | 0.14 | 200 | 12.0 | 27 |

Generally, for every given $Ir/HBF_4$ ratio, as the concentration of $NaBF_4$ increases the w/o Ir in the alloy deposit increases. However, the performance of deposits as anodes goes through a maximum at about 100 g/l $NaBF_4$. This suggests that the level of $NaBF_4$ in the bath should be controlled, e.g. at about 100 g/l, for optimum performance when the deposit from the bath is to be used as an anode material.

EXAMPLE 6

This example illustrates plating baths in accordance with the present invention.

Plating baths are formulated using ruthenium and iridium components prepared as described in EXAMPLES 1 and 2, respectively, and with the ruthenium and iridium in a weight ratio of 1 to 1, to give ruthenium-iridium deposits containing various amounts of iridium. Typical baths and plating conditions are tabulated in TABLE IV.

TABLE IV

| | Bath I | Bath II | Bath III | Bath IV |
|---|---|---|---|---|
| A. COMPOSITION, (g/l) | | | | |
| Ru | 8-9 | 8-9 | 3-4 | 3-4 |
| Ir | 8-9 | 8-9 | 3-4 | 3-4 |
| $NaBF_4$ | 100 | 100 | 75 | 75 |
| $HBF_4$ | 30 | 20 | 14 | 4 |
| $NH_2SO_3H$ | 7 | 7 | 6-7 | 5-7 |
| B. PLATING CONDITIONS | | | | |
| cd (mA/cm2) | 30 | 30 | 20 | 20 |
| T (°C.) | 70 | 70 | 60 | 60 |
| pH | 0.9 | 0.8 | 0.9 | 1.2 |
| C. Ir IN DEPOSIT | | | | |
| w/o | 3-4 | 5-6 | 8-9 | 23-24 |

EXAMPLE 7

This example illustrates the effect of current density and temperature on the iridium content of the deposit.

Using a bath of the following composition

| Ingredients | g/l |
|---|---|
| Ru | 1-2 |
| Ir | 1-2 |
| $NaBF_4$ | 100 |
| $HBF_4$ | 10 |
| $NH_2SO_3H$ | 7 |

the plating conditions are varied, e.g.:

A. at a temperature of 60° C. and pH=1.0 varying the cathode current density from 1-100 $mA/cm^2$ B. at a cathode current density of 30 $mA/cm^2$ varying the temperature from 20° to 70° C.

Results, tabulated in TABLES V and VI show that the % iridium deposited increases with both increase in temperature and increase in current density, respectively.

TABLE V

| Current Density, $mA/cm^2$ | Iridium in Deposit, w/o |
|---|---|
| 10 | 0.7 |
| 20 | 1.1 |
| 30 | 1.6 |
| 40 | 1.8 |
| 50 | 2.2 |
| 60 | 2.7 |
| 70 | 3.0 |
| 80 | 3.7 |
| 90 | 3.8 |
| 100 | 4.7 |

TABLE VI

| Temperature, °C. | Iridium in Deposit, w/o |
|---|---|
| RT* | <0.1 |
| 38 | 0.1 |
| 46 | 1.1 |
| 56 | 2.5 |
| 70 | 6.6 |

*RT = room temperature.

EXAMPLE 8

This example illustrates the use of various ruthenium and iridium salts as components of the present bath.

In the tests outlined below the specific ruthenium and iridium salts used to prepare the bath, the bath composition and plating conditions are given. All deposits are on a copper substrate. In all test samples the ruthenium-iridium alloy deposit is heat treated in air for 15 minutes at 593° C. before use in an accelerated life test. The results include the concentration of iridium in the ruthenium-iridium alloy deposit and observations on the quality of the deposits. "ALTC" refers to accelerated life test which is carried out as 500 $mA/cm^2$ at ambient temperature in 1 N $H_2SO_4$. The life is based on hours to 10 volts cell voltage and the results given related to the precious metal loading.

1. Salts: $RuCl_3.3H_2O$ and $(NH_4)_2IrCl_6$

A. Bath Composition

Ru=3-4 g/l

Ir=3-4 g/l $NaBF_4$=100 g/l $HBF_4$=10 g/l $NH_2SO_3H$=6-7 g/l

B. Plating Conditions cd=20 $mA/cm^2$

T=60° C.

pH=0.5

C. Results

1. [Ir], in alloy=7.0%

2. The deposit was not adherent-failed the tape test

2. Salts: $RuCl_3.3H_2O$ and $IrCl_3$

A. Bath Composition

Ru=3-4 g/l

Ir=3-4 g/l $NaBF_4$=100 g/l $HBF_4$=10 g/l $NH_2SO_3H$=6-7 g/l

B. Plating Conditions
cd=20 mA/cm$^2$
T=60° C.
pH=0.7
C. Results
1. [Ir], in alloy=26½%
2. Light, very shiny deposit, finely cracked at 500X at 1.4 mg/cm$^2$ loading.
3. ALTC: 55 hr/mg.
3. Salts: RuNC and $IrCl_3$
A. Bath Composition
Ru=3–4 g/l
Ir=3–4 g/l
$NaBF_4$=100 g/l
$HBF_4$=10 g/l
$NH_2SO_3H$=6–7 g/l
B. Plating Conditions
cd=20 mA/cm$^2$
T=60° C.
pH=0.9
C. Results
1. [Ir], in alloy=21.3%
2. Matte-grey deposit, under 500X, nodular in appearance.
3. ALTC: 426 hrs/mg.
4. Salts: RuNC and $(NH_4)_2IrCl_6$
A. Bath Composition
Ru=3–4 g/l
Ir=3–4 g/l
$NaBF_4$=100 g/l
$HBF_4$=10 g/l
$NH_2SO_3H$=6–7 g/l
B. Plating Conditions
cd=20 mA/cm$^2$
T=60° C.
pH=0.9
C. Results
1. [Ir], in alloy=1.7%
2. Deposit metallic
3. White turned light violet when treated
4. ALTC: 25 hrs/mg.

The results are included merely to indicate that iridium does plate out with ruthenium using a variety of compounds of iridium and ruthenium. However, it is noted that the examples do not represent optimized baths.

EXAMPLE 9

This example illustrates the effect of iridium and the effect of an oxidation treatment on an electroplated coating on titanium in the performance of such materials as an oxygen electrode.

Composite samples are prepared, all having an electroplated ruthenium-containing layer with an iridium content varied from 0 up to about 12%. All samples are prepared with an electroplated deposit directly on sandblasted and cleaned titanium sheet. Sample 1, containing no iridium, is prepared from a conventional ruthenium plating bath. The remaining samples are prepared using a plating bath according to the present invention designed to deposit ruthenium-iridium alloys. Each sample (except for Sample 4) after an electrodeposit of about 1 mg/cm$^2$ loading is subjected to a treatment at 593° C. in air for 15 minutes. The samples are used as anodes in a 1 N $H_2SO_4$ electrolyte operated at incremental current densities until a color change in the electrolyte is observed. White Teflon (Teflon is a du-Pont Trademark) tape inserted at the stopper for each test is removed and examined. Effluent gas from the test container is bubbled through a solution of 1:5 of $H_2SO_3$:$H_2O$. No noticeable change occurs in $H_2SO_3$. Observations are reported in TABLE VII.

The results in TABLE VII show:

The presence of iridium in the electrodeposit suppresses the corrosion of ruthenium in the anodic environment. As the iridium content increases from 0 to 3.9 and to 9.4% the current density at which coloring of the electrolyte begins rises from 30 to 50 and then to 250 mA/cm$^2$ and the deposits of the ruthenium-containing volatile decreased from black to trace amounts. (Compare Samples 1, 2, 3 and 5.)

From the results it can be seen that the optimum amount of iridium in the Ru-Ir can be predetermined for given conditions of operation based upon, e.g. corrosion and economics.

EXAMPLE 10

This sample illustrates the preparation of a composite material useful as an insoluble oxygen electrode and its use as an anode for electrowinning of nickel.

A titanium substrate is sandblasted with #2 sand to roughen the surface and to prime the surface with embedded silica. The sandblasted substrate is brushed with pumice, rinsed, cathodically cleaned in 0.5 M $Na_2CO_3$ to remove dirt and adhering pumice particles, rinsed, dried and weighed. Before plating the surface is water-rinsed and placed in a plating bath prepared using ruthenium and iridium components the compounds essentially as prepared in EXAMPLES 1 and 2, respectively, and composed of:

TABLE VII

| Sample | % Ir in Electroplated Coating | Deposit on Teflon Coated Stopper | [Ru] Conc. in Soln. g/l (approx.) | Observations on Electrolyte | Ingredients | g/l |
|---|---|---|---|---|---|---|
| 1 | 0 | Black** | 0.18 | Yellowing at 30 mA/cm$^2$ | Ru | 3–4 |
| 2 | 3.9 | Black | 0.003 | Yellowing at 50 mA/cm$^2$ | Ir | 3–4 |
| 3 | 6.8 | Trace | 0.003 | Possibly more red than yellow at 250 mA/cm$^2$ | $NaBF_4$ | 25 |
| 4 | 6.8* | Black-Brown | 0.0064 | Yellowing at 30 mA/cm$^2$ | $HBF_4$ | 10 |
| 5 | 9.4 | Trace | 0.003 | Pinking at 250 mA/cm$^2$ | $NH_2SO_3H$ | 6–7 |
| 6 | 11.3 | Trace | 0.003 | Pinking at 250 mA/cm$^2$ | $H_3BO_3$ | 10 |

*No oxidation treatment.
**Deposit checked by x-ray fluorescence which showed the presence of iridium.

Plating is carried out at a temperature of 60° C., pH=1, and a current density of 20 mA/cm$^2$ to form a coherent, adherent co-deposit of ruthenium and iridium as an alloy containing 12 weight percent iridium and having a loading of about 1 mg/cm$^2$. The deposit is bright metallic.

The Ru-Ir coated titanium is heat treated in air for 15 minutes at 593° C. to oxidize at least the surface of the co-deposit. This initial oxidation is evidenced by a color change from metallic to light violet.

After oxidation the electrode is tested at conditions which simulate nickel electrowinning at high temperature. The electrolyte is made up of 60 to 80 g/l nickel (as nickel sulfate), 40 g/l sulfuric acid, 100 g/l sodium sulfate and 10 g/l boric acid. With the electrolyte temperature at 70° C., the pH of about 0 to 0.5 and at an anode current density of about 30 mA/cm$^2$, the life of the electrode is over 3600 hours at a working potential of 1.27–1.31 volts/SCE.

EXAMPLE 11

This example illustrates the use of an electrode in accordance with this invention used for electrowinning nickel-cobalt.

An anode assembly is prepared of 21 sandblasted titanium-sheathed rods, each about 40" long×½" diameter, connected by a stainless steel cross bar. Each rod has a coating of 1 to 1.5 μm of Ru-4Ir prepared from a plating bath of this invention and heat treated at 593° C. for 15 minutes in air. The anode assembly is immersed in an aqueous electrolyte containing in solution about 70–80 g/l nickel, 25–30 g/l cobalt, 40–80 g/l $H_2SO_4$, 10 g/l $H_3BO_3$ and 100 g/l $Na_2SO_4$. The cell is operated at 55° C. and anode current densities ranging from about 5 to 50 mA/cm$^2$, using a 60Ni-40Co starter sheet as cathode. Under these conditions the anode potential is within the range of about 1.15 to 1.25 volts/SCE.

Analysis of the recovered deposit for elements other than Ni and Co shows, in ppm:

<15 Pb, <100 Fe, <100 Cu, <60 Zn, <150 C, <20 Si, <80 S, <20 Sb, <100 Mo, <5 Mn, <2 each B, Bi, Al, Be, Ba, Ga, Ag, Te, Sn, As, <5 H, <100 O, <50 N.

Electrodes prepared from baths of the present invention may be used for other electrolysis applications in addition to electrowinning metals. For example, they may be used for the electrolytic production of chlorine from brine, the dissociation of water and cathodic protection. They may also be used for battery electrodes. With respect to electrowinning applications, they may be used as anodes for recovering metals in addition to nickel and nickel-cobalt, e.g. copper, zinc, manganese, cobalt, cadmium, gallium, iridium and alloys thereof.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

What is claimed is:

1. An aqueous electrolytic acid bath for electrodeposition of a ruthenium-iridium alloy, said bath comprising a soluble ruthenium compound, a soluble iridium compound, a soluble fluoborate salt, and fluoboric acid.

2. An aqueous electrolytic bath according to claim 1, wherein the fluoborate is a salt of an alkali metal or ammonium.

3. A method of electrodepositing a ruthenium-iridium alloy which comprises passing a substantially direct current through the aqueous acid bath of claim 1.

4. A method according to claim 3, wherein the current is passed through the bath at a cathode current density of about 5 to about 120 mA/cm$^2$ and at a temperature in the range of room temperature to about 95° C.

5. An aqueous electrolytic bath for electrodeposition of a ruthenium-iridium alloy, wherein the bath comprises about 1–12 g/l ruthenium, about 1–12 g/l iridium, about 10–200 g/l (equivalent to $NaBF_4$) fluoborate salt, about 1–100 g/l fluoboric acid and sulfamic acid in an amount of up to about 2 times the Ru-Ir concentration.

6. An aqueous electrolytic bath according to claim 5, wherein the Ru and Ir are present in concentrations of about 3–10 g/l, respectively.

7. An aqueous electrolytic bath according to claim 5, wherein the bath initially contains ruthenium and iridium in a ratio substantially of about 1:1, by weight.

8. An aqueous electrolytic bath according to claim 5, wherein the fluoborate salt concentration is at least about 25 g/l.

9. An aqueous electrolytic bath according to claim 5, wherein the fluoboric acid concentration is at least about 5 g/l.

10. An aqueous electrolytic bath according to claim 5, wherein the pH is between about 0.3 and about 1.5.

11. An aqueous electrolytic bath according to claim 5, wherein $H_3BO_3$ is present.

12. An aqueous electrolytic bath according to claim 5, wherein the bath is prepared using RuNC as the source of soluble ruthenium.

13. An aqueous electrolytic bath according to claim 5, wherein the bath is prepared using the reaction product of diammonium hexahalo iridate IV refluxed in sulfamic acid as the source of soluble iridium.

14. An aqueous electrolytic acid bath for electrodeposition of a ruthenium-iridium alloy, said bath comprising a soluble ruthenium compound, a soluble iridium compound, a soluble fluoborate salt, and fluoboric acid, wherein the pH is between about 0.3 and 1.5.

15. An aqueous electrolytic bath according to claim 14, wherein the bath comprises about 1–12 g/l ruthenium, about 1–12 g/l iridium, about 10–200 g/l (equivalent to $NaBF_4$) fluoborate salt, about 1–100 g/l fluoboric acid and sulfamic acid in an amount of up to about 2 times the ruthenium plus iridium concentration, and wherein the bath is prepared using a complex anion represented by the formula $[Ru_2N(H_2O)_2Y_8]^{3-}$ where Y is chlorine or bromine as the ruthenium component and the reaction product of a diammonium hexahalo iridate IV refluxed in sulfamic acid as the iridium component.

16. An aqueous electrolytic acid bath for electrodeposition of a ruthenium-iridium alloy, said bath comprising a soluble ruthenium compound providing about 1 to about 12 g/l ruthenium, a soluble iridium compound providing about 1 to about 12 g/l iridium, a soluble fluoborate salt providing an amount equivalent to about 10 to about 200 g/l sodium fluoborate, and fluoboric acid in an amount of about 1 to about 100 g/l.

17. An aqueous electrolytic acid bath according to claim 16 wherein the bath contains sulfamic acid.

18. A method of depositing a ruthenium-iridium alloy which comprises passing a substantially direct current through an aqueous bath of claim 16.

19. A method according to claim 18, wherein the current is passed through the bath at a cathode current density of about 5 to about 120 mA/cm$^2$ and at a temperature in the range of about room temperature to about 95° C.

20. A method of electrodepositing a ruthenium-iridium alloy which comprises passing a substantially direct current through the aqueous acid bath comprising about 1–12 g/l ruthenium, about 1–12 g/l iridium, about 10–200 g/l (equivalent to $NaBF_4$) fluoborate salt, about 1–100 g/l fluoboric acid and sulfamic acid in an amount of up to about 2 times the Ru-Ir concentration.

21. A method of electrodepositing a ruthenium-iridium alloy which comprises passing a substantially direct current through the aqueous acid bath comprising about 1–12 g/l ruthenium, about 1–12 g/l iridium, about 10–200 g/l (equivalent to $NaBF_4$) fluoborate salt, about 1–100 g/l fluoboric acid and sulfamic acid in an amount of up to about 2 times the Ru-Ir concentration, wherein the bath is maintained at a temperature in the range of about room temperature to about 95° C. and the cathode current density of about 5 to about 120 $mA/cm^2$.

22. A method according to claim 21, wherein the pH is maintained at about 0.3 to about 1.5.

23. A method according to claim 21, wherein the bath is prepared using as the ruthenium and iridium components, respectively, a complex anion represented by the formula $[Ru_2N(H_2O)_2Y_8]^{3-}$, wherein Y is chlorine or bromine, and the reaction product of diammonium hexachloro iridium IV refluxed in sulfamic acid.

24. In a process for electrowinning metals selected from the group consisting of nickel, copper, zinc, manganese, cobalt, cadmium, gallium, iridium, and alloys thereof, from an aqueous electrolyte, the improvement comprising using as the anode a composite electrode comprising a coating prepared from the bath comprising about 1–12 g/l ruthenium, about 1–12 g/l iridium, about 10–200 g/l (equivalent to $NaBF_4$) fluoborate salt, about 1–100 g/l fluoboric acid and sulfamic acid in an amount of up to 2 times the ruthenium plus iridium concentration.

25. The process of claim 24, wherein the metal electrowon is nickel.

26. The process of claim 24, wherein the metal electrowon is nickel-cobalt.

27. A composite electrode comprising an electrically conductive substrate and a coating, said coating comprising a ruthenium-iridium alloy electrolytically deposited from a bath comprising, in solution: ruthenium in the amount of about 1 to about 12 grams per liter, iridium in the amount of about 1 to about 12 grams per liter, a fluoborate salt an amount equivalent to about 10 to about 200 grams per liter sodium fluoborate, and fluoboric acid in the amount of about 1 to about 100 grams per liter.

28. A composite according to claim 27, wherein the electrically conductive substrate comprises a valve metal.

29. A composite electrode according to claim 28, wherein the valve metal is coated with a barrier layer selected from the group consisting of platinum group metals and gold, and the ruthenium-iridium alloy is deposited on the barrier layer.

30. A composite electrode according to claim 29, wherein the barrier layer is selected from the group consisting of palladium, iridium and gold.

31. A composite electrode according to claim 28, wherein the ruthenium-iridium alloy deposit has a thickness of at least about 0.1 μm.

32. A composite electrode according to claim 28, wherein the ruthenium-iridium alloy deposit is at least partially oxidized at the surface.

33. A composite electrode comprising an electrically conductive substrate and a coating, said coating comprising a ruthenium-iridium alloy electrolytically deposited at a cathode current density of about 5 to about 120 $mA/cm^2$ and at a temperature in the range of about room temperature to about 95° C. from a bath comprising, in solution: ruthenium in the amount of about 1 to about 12 grams per liter, iridium in the amount of about 1 to about 12 grams per liter, a fluoborate salt in an amount equivalent to about 10 to about 200 grams per liter sodium fluoborate, and fluoboric acid in the amount of about 1 to about 100 grams per liter.

34. A composite according to claim 33, wherein the electrically conductive substrate comprises a valve metal.

35. A composite electrode according to claim 34, wherein the valve metal is coated with a barrier layer selected from the group consisting of platinum group metals and gold, and the ruthenium-iridium alloy is deposited on the barrier layer..

36. A composite electrode according to claim 35, wherein the barrier layer is selected from the group consisting of palladium, iridium and gold.

37. A composite electrode according to claim 33, wherein the ruthenium-iridium alloy deposit has a thickness of at least about 0.1 μm.

38. A composite electrode according to claim 33, wherein the ruthenium-iridium alloy deposit is at least partially oxidized at the surface.

* * * * *